US007156255B2

(12) United States Patent
Raft

(10) Patent No.: US 7,156,255 B2
(45) Date of Patent: Jan. 2, 2007

(54) SELF-RIGHTING SIPPER CUP

(76) Inventor: Alex D. Raft, 15216 Cambridge Terrace Cir., Chesterfield, MO (US) 63017

( * ) Notice: Subject to any disclaimer, the term of this patent is extended or adjusted under 35 U.S.C. 154(b) by 205 days.

(21) Appl. No.: 10/889,648

(22) Filed: Jul. 12, 2004

(65) Prior Publication Data

US 2006/0006182 A1 Jan. 12, 2006

(51) Int. Cl.
*B65D 6/28* (2006.01)
*B65D 19/22* (2006.01)

(52) U.S. Cl. ..... 220/603; 220/714; 220/705

(58) Field of Classification Search ..... 220/603, 220/714, 578, 717, 705, 710, 710.5, 719; 215/388, 389, 11.4
See application file for complete search history.

(56) References Cited

U.S. PATENT DOCUMENTS 4,303,170 A 12/1981 Panicci
4,388,996 A 6/1983 Panicci
4,442,948 A * 4/1984 Levy et al. ..... 220/710
4,832,212 A 5/1989 Askinazi
4,953,737 A 9/1990 Meyers
5,005,717 A * 4/1991 Oilar ..... 215/13.1
5,294,018 A * 3/1994 Boucher ..... 220/603
5,515,995 A 5/1996 Allen et al.
6,640,992 B1 11/2003 Berger et al.
6,976,604 B1 * 12/2005 Connors et al. ..... 220/713
2003/0218016 A1 * 11/2003 Iskierka ..... 220/216
2005/0178775 A1 * 8/2005 Burke et al. ..... 220/710.5

* cited by examiner

*Primary Examiner*—Jes F. Pascua
*Assistant Examiner*—Shawn M. Braden
(74) *Attorney, Agent, or Firm*—Dale J. Ream

(57) ABSTRACT

A self-righting sipper cup includes an inner cup member positioned in an interior space defined by an outer cup member. The inner cup's bottom defines an outlet port. A channel connects the outlet port to a drinking slot surrounded by a drinking spout. The inner cup receives liquid, and a float rests atop the liquid. A lid attaches. A child lifts the cup by handles and drinks traditionally through the spout or sucks on the spout in either an upright or horizontal position. The float descends as liquid leaves the interior cup. If the cup drops or tips, liquid stays at the bottom of the interior cup and in the channel due to the float and a valve inside the channel. The shapes of the rounded base portion and handles, a ballast's weight, and the liquid's location bias the cup to the upright position.

16 Claims, 4 Drawing Sheets

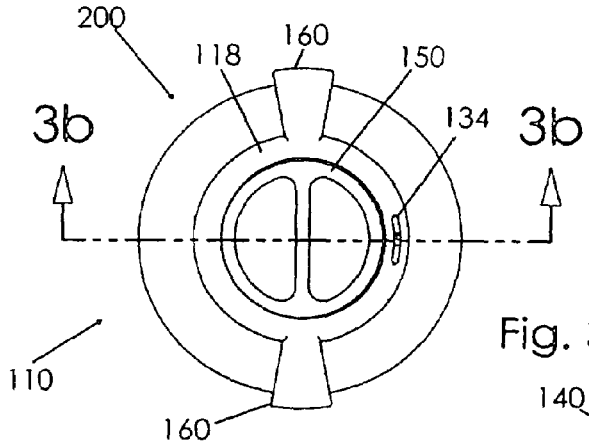
Fig. 3a
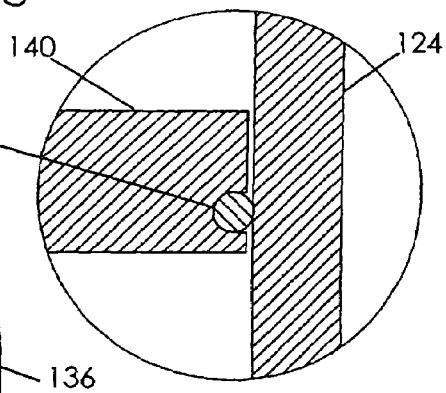
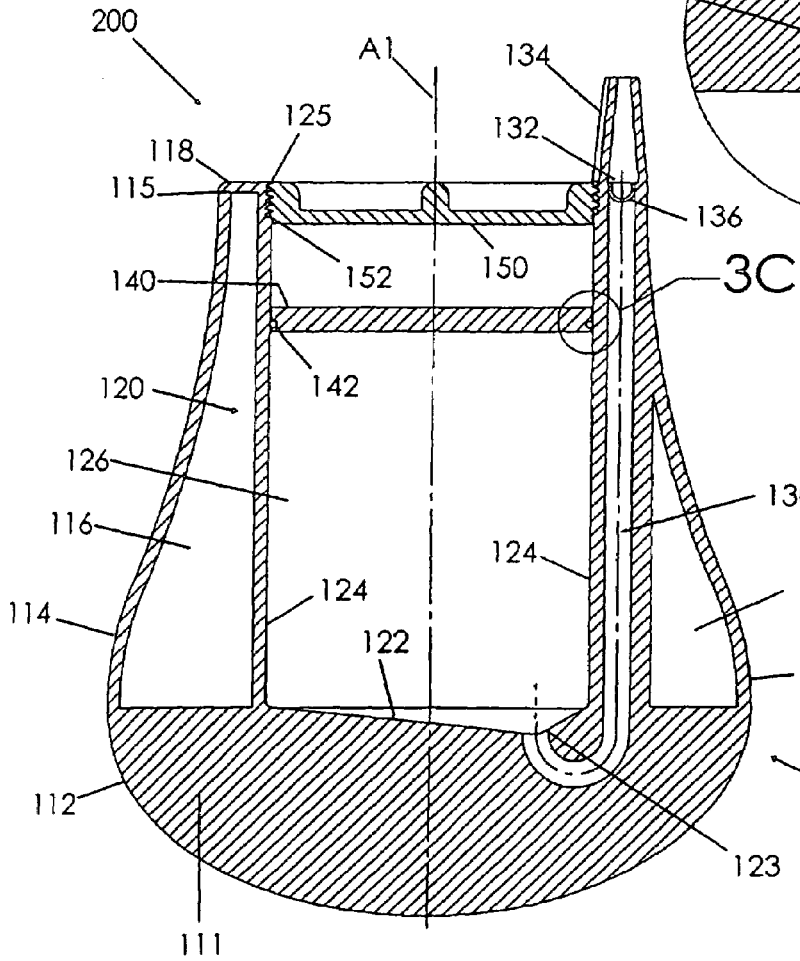
Fig. 3c
Fig. 3b

SELF-RIGHTING SIPPER CUP

BACKGROUND OF THE INVENTION

This invention relates generally to a child's sipper cup. In particular, the present invention relates to a self-righting and spill-minimizing sipper cup that includes features of both a cup and a straw.

The traditional sipper cup is used to teach children to drink from a cup on their own, minimizing the spills through a small sipping spout. Nevertheless, as children have learned to drink and eat on their own, accidents and messes have proven inevitable.

It is important to keep liquid at the bottom of the cup's interior because this helps maintain the cup's low center of gravity. If this is not done, the weight of the liquid will increase the weight of the cup's sidewalls when the cup is tipped, allowing the cup to continue or accelerate its motion of falling to its side.

Various proposals for self-righting cups are found in the art. Self-righting cups with rounded bottoms can be found in U.S. Pat. No. 4,303,170, U.S. Pat. No. 4,388,996, U.S. Pat. No. 4,953,737, U.S. Pat. No. 5,294,018, and U.S. Pat. No. 6,640,992. None of these include either a base portion wider than an upper portion or a double-wall construction, however. Further, none of these proposals suggest incorporating a straw-like device into a child's sipper cup. In fact, U.S. Pat. No. 6,640,992 expressly teaches away from adding a straw-like feature, claiming a spout encourages children to develop improper drinking techniques. Likewise, none of these suggest including a float device to keep liquid in the bottom of the cup.

U.S. Pat. No. 5,217,141 and U.S. Pat. No. 5,515,995 disclose spill-resistant cups with base portions wider than upper portions and double-wall constructions. However, neither cup is self-righting and neither suggests adding a straw-like feature or a float device to keep liquid in the bottom of the cup.

Therefore, it is desirable to have a self-righting and spill-minimizing sipper cup that includes features of both a cup and a straw, keeps liquid in the cup at the bottom of the cup's interior, maintains the temperature of liquid contained in the cup, is lightweight, easy for a child to hold, easy to clean, and aesthetically pleasing.

SUMMARY OF THE INVENTION

A self-righting sipper cup according to the present invention includes an outer cup member, an inner cup member, a channel, a drinking slot, a drinking spout, a valve, a float, a removable lid, handles, and a ballast. The inner cup member is positioned in an interior space defined by the outer cup member, and the inner cup member defines an outlet port at a bottom wall of the inner cup member. The drinking slot is adjacent the top of the outer cup member and is connected to the outlet port by the channel. The drinking spout surrounds the drinking slot. The valve is positioned inside the channel adjacent the drinking slot for selectively retaining liquid contained inside the self-righting sipper cup, and the float is positioned inside the inner cup member for limiting the movement of liquid contained in the self-righting sipper cup. A rounded base portion of the outer cup member is wider than an upper portion of the outer cup member, and the rounded base portion of the outer cup member includes the ballast. The handles attach to the outer cup member and are rounded to brace the self-righting sipper cup if the self-righting sipper cup is upended.

In use, liquid is placed in the inner cup member. The float is then inserted in the inner cup member and rests atop the liquid. The removable lid is then attached. A child can pick up the self-righting sipper cup by the handles and suck on the drinking spout in either an upright or horizontal position. When the child sucks on the drinking spout, liquid flows through the outlet port, the channel, the valve, and the drinking spout to reach the child's mouth. If the valve is not included, the child may either drink traditionally (without sucking) through the drinking spout or treat the drinking spout as a straw. As the liquid is drawn out of the interior space, the float is drawn to the bottom of the interior cup member and a vacuum is established to bias the liquid to the outlet port. If the self-righting sipper cup is dropped or tipped, the liquid will stay at the bottom of the interior cup member and in the channel due to the float and the valve. The shapes of the rounded base portion of the outer cup member and the handles, along with the weight of the ballast and the location of the liquid, bias the self-righting sipper cup to the upright position. By including both features of a cup and a straw, the child is able to suck from the cup in an upright position or tip it up and drink traditionally. This helps the development of the child's ability to learn to eat and drink on his own.

Therefore, a general object of this invention is to provide a self-righting sipper cup that includes features of both a cup and a straw.

Another object of this invention is to provide a self-righting sipper cup, as aforesaid, that keeps liquid in the cup at the bottom of the cup's interior.

Still another object of this invention is to provide a self-righting sipper cup, as aforesaid, that maintains the temperature of liquid contained in the cup.

Yet another object of this invention is to provide a self-righting sipper cup, as aforesaid, that is lightweight and easy for a child to hold.

A further object of this invention is to provide a self-righting sipper cup, as aforesaid, that is easy to clean.

A still further object of this invention is to provide a self-righting sipper cup, as aforesaid, having an aesthetically pleasing configuration.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 3*a* is a top view of a self-righting sipper cup according to another embodiment of the present invention;

FIG. 3*b* is a sectional view taken along line 3*b*–3*b* of FIG. 3*a;*

FIG. 3*c* is an isolated sectional view on an enlarged scale of a float, float seal, and inner wall as in FIG. 3*b*.

DESCRIPTION OF THE PREFERRED EMBODIMENT

Figure 1:
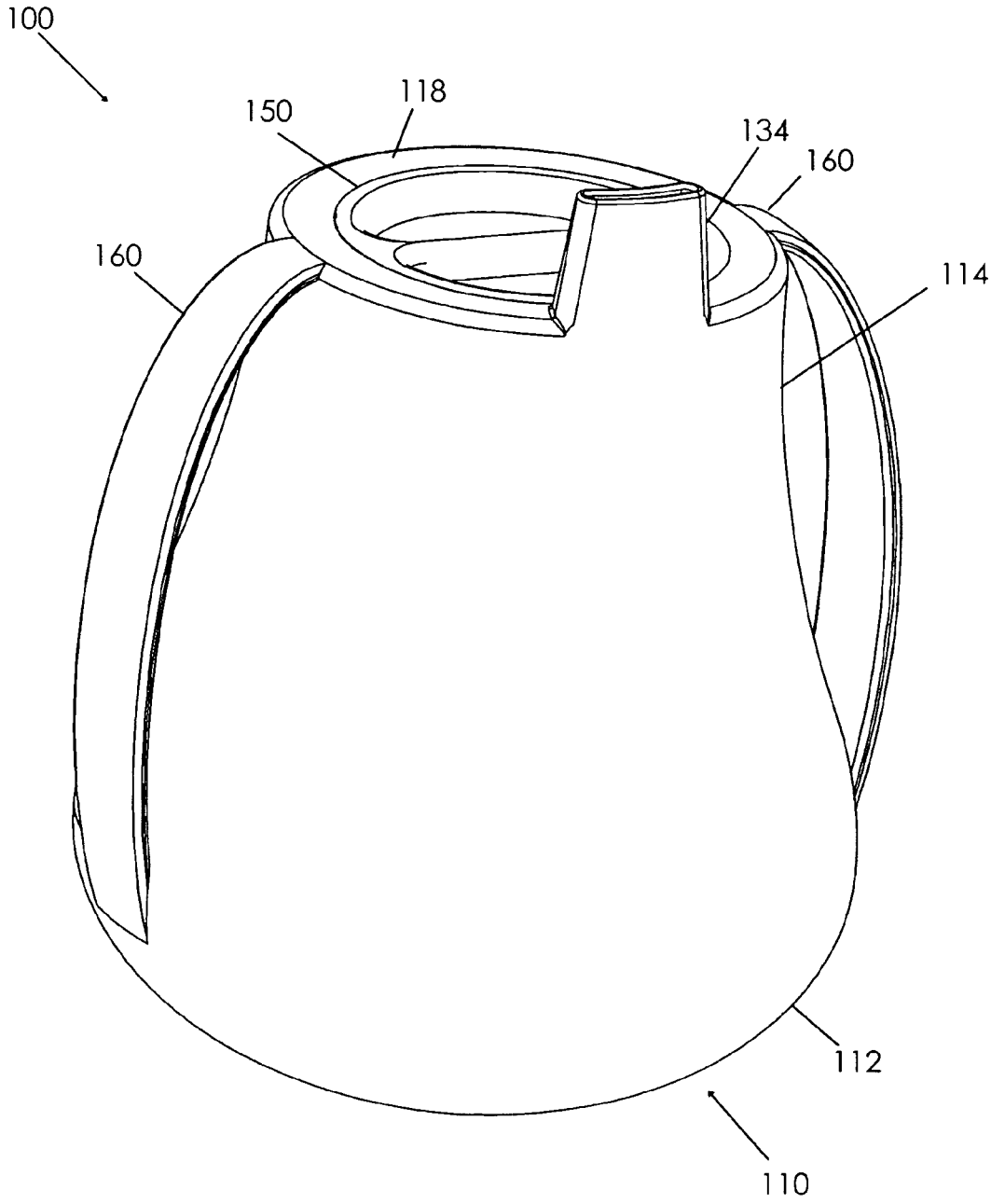
FIG. 1 is a perspective view of a self-righting sipper cup according to one embodiment of the present invention.

A self-righting sipper cup according to the present invention will now be described in detail with reference to FIGS. 1 through 4 of the accompanying drawings. More particularly, a self-righting sipper cup 100 according to one embodiment includes an outer cup member 110, an inner cup member 120, a channel 130, a drinking slot 132, a drinking spout 134, a valve 136, a removable lid 150, handles 160, and a ballast 111.

The outer cup member 110 has a continuous outer wall (outer wall) 114 situated atop a rounded base portion 112. The outer wall 114 defines an open top 115 and an interior space 116. The rounded base portion 112 and the open top 115 have a common vertical axis A1 (FIG. 3*b*). The rounded base portion 112 presents a diameter that is greater than a diameter of the open top 115. The outer cup member 110 has a truncated pear-shaped configuration. The ballast 111 is positioned in the rounded base portion 112. By using a rounded base portion 112 that extends wider than the open top 115 and includes a ballast 111, the center of gravity of the self-righting sipper cup 100 is low and the self-righting sipper cup 100 is biased to an upright state even if tipped.

The inner cup member 120 has a continuous inner wall (inner wall) 124 with a closed bottom wall 122 and defines an open top 125 and an interior space 126. The inner wall 124 is positioned in the interior space 116 of the outer cup member 110 and shares the common vertical axis A1 with the rounded base portion 112 and the open top 115. A rim 118 connects the top of the outer cup member 110 and the top of the inner cup member 120.

Figure 2A:
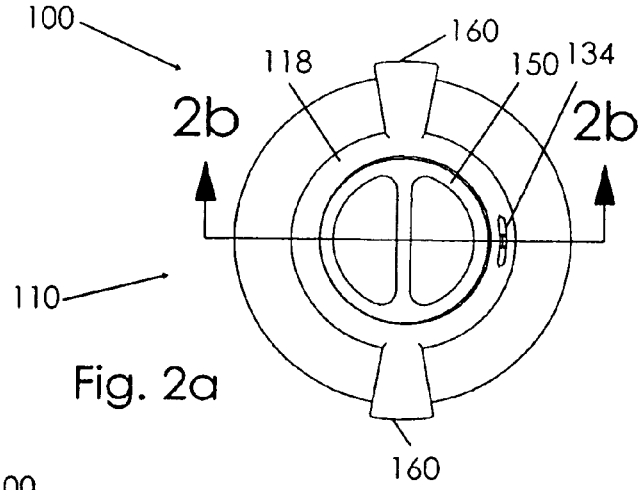
FIG. 2*a* is a top view of the self-righting sipper cup as in FIG. 1.
Figure 2B:
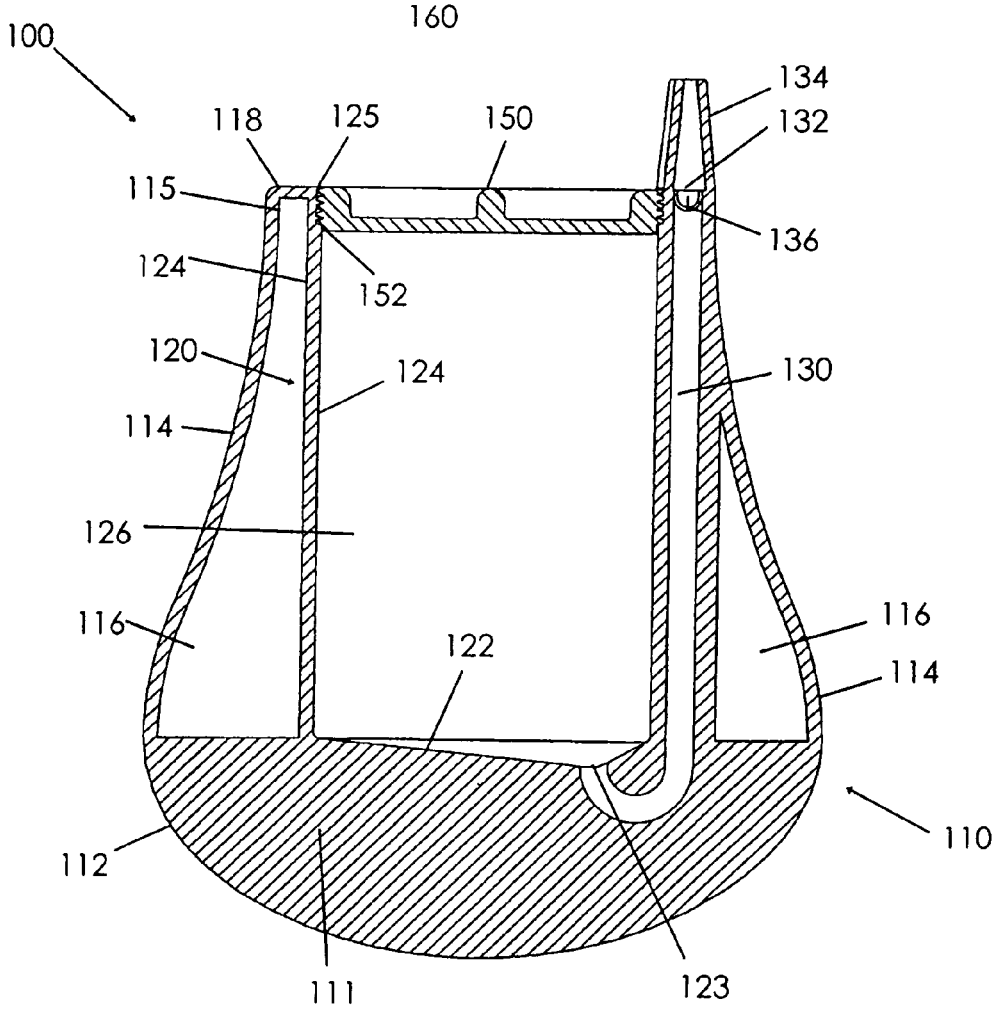
FIG. 2*b* is sectional view taken along line 2*b*—2*b* of FIG. 2*a;*

The closed bottom wall 122 defines an outlet port 123, and the drinking slot 132 is positioned in the rim 118 adjacent the open top 115 of the outer cup member 110. The channel 130 extends through the interior space 116 of the outer cup member 110 and connects the outlet port 123 with the drinking slot 132. The channel 130 is outwardly adjacent the inner wall 124 (FIG. 2*b*).

The drinking spout 134 is positioned on the rim 118 adjacent the open top 115 of the outer cup member 110 and surrounding the drinking slot 132. The valve 136 is positioned inside the channel 130 adjacent the drinking slot 132 for selectively retaining any liquid contained inside the self-righting sipper cup 100.

A peripheral edge 152 of the removable lid 150 is preferably threaded, and the inner cup member 120 is preferably threaded adjacent the open top 125 for receiving the removable lid 150. Other methods of attaching the removable lid 150 are of course possible, however.

The handles 160 attach to the outer cup member 110 and are rounded to brace and stabilize the self-righting sipper cup 100 if the self-righting sipper cup 100 is upended. The handles 160 are small enough for a child's small hands to hold onto.

The interior space 116 between the outer cup member 110 and the inner cup member 120 acts as insulation for the contents of the interior space 126. This use of an outer cup member 110 and an inner cup member 120 may be referred to as double-wall construction and acts to maintain the temperature of liquid contained in the self-righting sipper cup 100. Insulation (not shown) may optionally fill the interior space 116 between the outer cup member 110 and the inner cup member 120.

In use, liquid is placed in the interior space 126 of the inner cup member 120 through the open top 125. The removable lid 150 is then attached to the inner cup member 120. A child can pick up the self-righting sipper cup 100 by the handles 160 and suck on the drinking spout 134 in either an upright or horizontal position. When the child sucks on the drinking spout 134, liquid flows through the outlet port 123, the channel 130, the valve 136, and the drinking spout 134 to reach the child's mouth. If the valve 136 is not included, the child may either drink traditionally (without sucking) through the drinking spout 134 or treat the drinking spout 134 as a straw.

If the self-righting sipper cup 100 is dropped or tipped, the liquid will remain in the interior space 126 and the channel 130 due to the removable lid 150 and the valve 136. The shapes of the rounded base portion 112 and the handles 160 and the weight of the ballast 111 bias the self-righting sipper cup 100 to the upright position.

Figure 4:
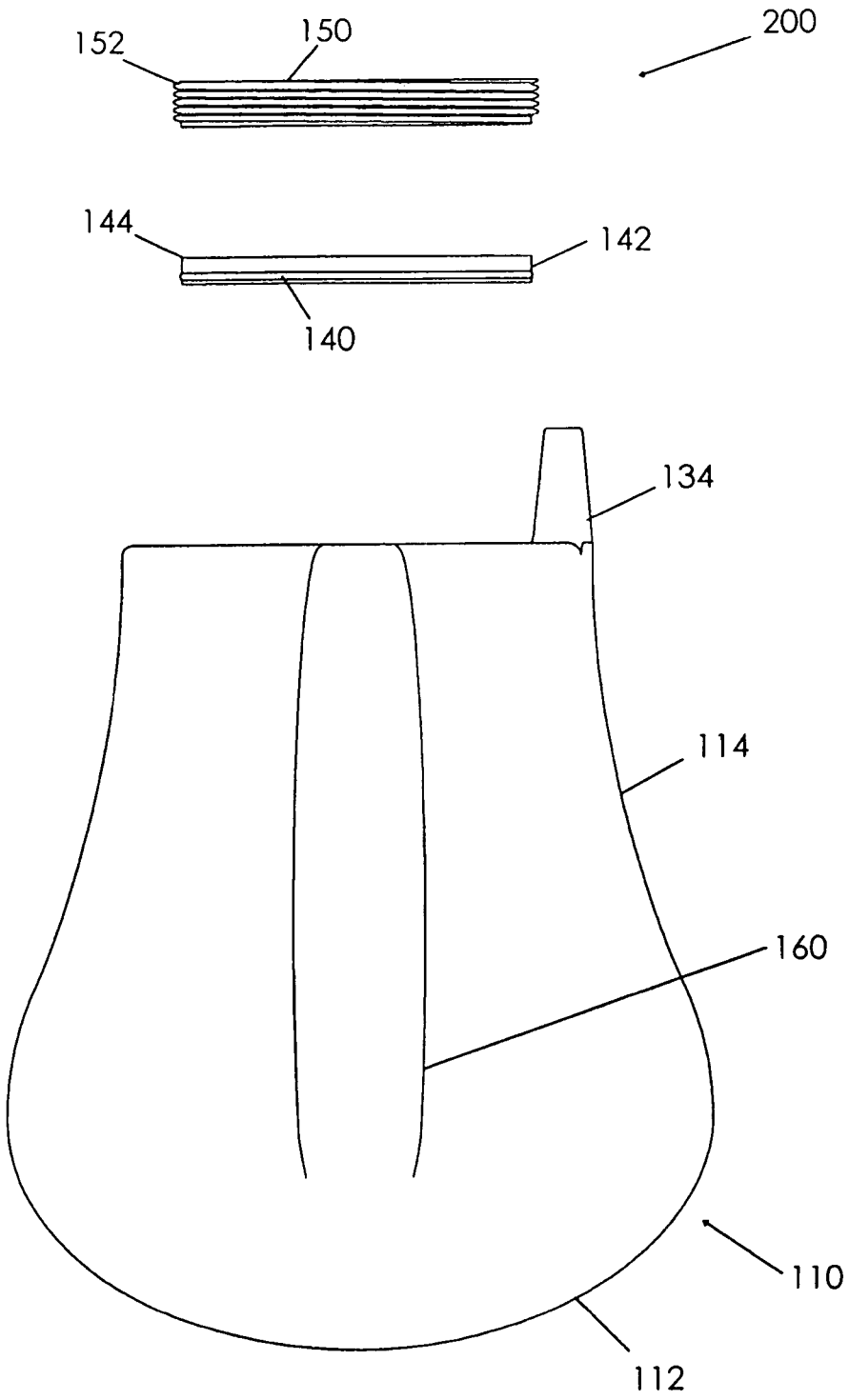
FIG. 4 is an exploded view of the self-righting sipper cup as in FIG. 3*a*.

A self-righting sipper cup 200 according to another embodiment of the present invention is shown in FIGS. 3*a* through 4 and includes a construction substantially similar to the construction previously described except as specifically noted below. More particularly, the self-righting sipper cup 200 according to this embodiment includes a float 140.

The float 140 fits inside the inner cup member 120 for limiting movement of any liquid contained in the self-righting sipper cup 200. By limiting the liquid's movement, the center of gravity remains relatively constant whether the self-righting sipper cup 200 is upright or tipped. The weight of the liquid does not increase the weight of the cup's sidewalls since the float 140 keeps the liquid from shifting to the sidewalls. The float 140 includes a seal 142 and has a sufficient wall thickness 144 perpendicularly adjacent the inner cup member 120 to ensure the float 140 only moves along the vertical axis A1 of the inner wall 124 (FIG. 3*b*).

In use, liquid is placed in the interior space 126 of the inner cup member 120 through the open top 125. The float 140 is then inserted in the interior space 126 of the inner cup member 120 through the open top 125 and rests atop the liquid. The removable lid 150 is then attached to the inner cup member 120. As the liquid is drawn out of the interior space 126 through the outlet port 123, the float 140 is drawn to the bottom of the interior space 126 and a vacuum is established to bias the liquid to the outlet port 123.

If the self-righting sipper cup 200 is dropped or tipped, the liquid will stay at the bottom of the interior space 126 and in the channel 130 due to the float 140 and the valve 136. The shapes of the rounded base portion 112 and the handles 160, along with the weight of the ballast 111 and the location of the liquid, bias the self-righting sipper cup 200 to the upright position.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A self-righting sipper cup, comprising:

an outer cup member having a continuous outer wall situated atop a rounded base portion, said continuous outer wall defining an open top and an interior space;

an inner cup member having a continuous inner wall with a closed bottom wall and defining an open top, said inner cup member being positioned in said interior space of said outer cup member;

a ballast positioned in said rounded base portion;

wherein said closed bottom wall of said inner cup member defines an outlet port;

a drinking, slot positioned adjacent said open top of said outer cup member;

a channel extending through said interior space of said outer cup member and connecting said outlet port with said drinking slot;

a removable lid for selectively covering said open top of said inner cup member, whereby to releasably seal said open top of said inner cup member;

wherein said inner cup member includes a plurality of threads adjacent said open top; and wherein a peripheral edge of said removable lid includes a plurality of threads complementary to said threads of said inner cap member, whereby said removable lid is releasably coupled to said inner cup member.

2. The self-righting sipper cup as in claim 1 wherein said channel is outwardly adjacent said continuous inner wall.

3. The self-righting sipper cup as in claim 1 further comprising a drinking spout positioned adjacent said open top of said outer cup member and surrounding said drinking slot.

4. The self righting sipper cup as in claim 3 further comprising a valve positioned inside said channel and adjacent said drinking slot for selectively retaining liquid contained inside said self-righting sipper cup.

5. The self-righting sipper cup as in claim 1 wherein;

said rounded base portion and said open top defined by said outer wall define a common imaginary vertical axis; and said outer cup member has a truncated pear-shaped configuration.

6. The self-righting sipper cup as in claim 5 further comprising:

a float positioned in said inner cup member for limiting movement of liquid contained in said self-righting sipper cup; and a removable lid; wherein:

said inner cup member includes a plurality of threads adjacent said open top; and a peripheral edge of said removable lid includes a plurality of threads complementary to said threads of said inner cup member, whereby said removable lid is releasably coupled to said inner cup member.

7. The self-righting sipper cup as in claim 1 further comprising at least one handle connected to said continuous cuter wall for a child to hold.

8. The self-righting sipper cup as in claim 7 wherein said at least one handle has a rounded configuration for stabilizing said self-righting sipper cup if said self-righting sipper cup is tipped.

9. A self-righting sipper cup, comprising:

an outer cup member having a continuous outer wall situated atop a rounded base portion, said continuous outer wall defining an open top and an interior apace;

an inner cup member having a continuous inner wall with a closed bottom wall and defining an open top, said inner cup member being positioned in said interior space of said outer cup member, and said closed bottom of said inner cup member defining an outlet port;

a drinking slot positioned adjacent said open top of said outer cup member;

a channel extending through said interior space of said outer cup member and connecting said outlet port with said drinking slot;

a float positioned in said inner cup member for limiting movement of liquid contained in said self-righting sipper cup;

a ballast positioned in said rounded base portion;

wherein said rounded base portion and said open top defined by said outer wall define a common vertical axis; and wherein said outer cup member has a truncated near-shaped configuration.

10. The self-righting sipper cup as in claim 9 wherein said channel is situated outwardly adjacent said continuous inner wall.

11. The self-righting sipper cup as in claim 9 wherein:

said inner cup member defines a vertical axis; and said float has a sufficient wall thickness perpendicularly adjacent said inner cup member such that said float travels along said vertical axis of said inner cup.

12. The self-righting sipper cup as in claim 9 further comprising a drinking spout positioned adjacent said open top of said outer cup member and surrounding said drinking slot.

13. The self-righting sipper cup as in claim 12 wherein said float includes a seal for establishing a vacuum such that liquid in said inner cup member is biased toward said outlet port.

14. The self-righting sipper cup as in claim 12 further comprising a valve positioned inside said channel and adjacent said drinking slot for selectively retaining liquid contained inside said self-righting sipper cup.

15. The self-righting sipper cup as in claim 9 further comprising a removable lid for selectively covering said open top of said inner cup member, whereby to releasably seal said open top of said inner cup member.

16. The self righting sipper cup as in claim 9 further comprising a plurality of handles connected to said continuous outer wall and spaced apart from one another for stabilizing said outer cup member when tipped over, each handle having a generally arcuate configuration.

* * * * *